US010128603B2

(12) United States Patent
Duggan et al.

(10) Patent No.: US 10,128,603 B2
(45) Date of Patent: Nov. 13, 2018

(54) HIGH POWER CONNECTOR

(71) Applicant: Molex, LLC, Lisle, IL (US)

(72) Inventors: Francis Duggan, Shannon (IE); Andreas Vogt, Untergimpern (DE)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/503,194

(22) PCT Filed: Aug. 13, 2015

(86) PCT No.: PCT/US2015/045027

§ 371 (c)(1),
(2) Date: Feb. 10, 2017

(87) PCT Pub. No.: WO2016/025696

PCT Pub. Date: Feb. 18, 2016

(65) Prior Publication Data

US 2017/0237194 A1 Aug. 17, 2017

Related U.S. Application Data

(60) Provisional application No. 62/037,353, filed on Aug. 14, 2014.

(51) Int. Cl.
*H01R 13/426* (2006.01)
*H01R 13/22* (2006.01)
*H01R 13/03* (2006.01)

(52) U.S. Cl.
CPC ..... *H01R 13/426* (2013.01); *H01R 13/03* (2013.01); *H01R 13/22* (2013.01)

(58) Field of Classification Search
CPC ..... H01R 4/4818; H01R 13/426
USPC ..... 439/840, 841, 788, 827
See application file for complete search history.

(56) References Cited

U.S. PATENT DOCUMENTS 3,154,632 A * 10/1964 Browne ..... F16L 27/12 174/78
4,966,564 A * 10/1990 Foote ..... H01R 13/187 439/840
4,975,085 A * 12/1990 Cartesse ..... H01R 13/65802 439/607.17
5,024,604 A 6/1991 Savin et al.
5,454,735 A * 10/1995 Nelson ..... H01R 13/6277 439/578

(Continued)

FOREIGN PATENT DOCUMENTS

GB 1473676 A 5/1977
JP 58-66272 A 4/1983

(Continued)

*Primary Examiner* — Tulsidas C Patel
*Assistant Examiner* — Marcus Harcum
(74) *Attorney, Agent, or Firm* — Clarence R. Moon

(57) ABSTRACT

A high power electrical connector includes a plug and receptacle for use in a power transmission system. The plug includes a wire conductor attached to a mounting end and a circular contacting portion extending from a second end. The plug is configured to mate with a receptacle connector having a sleeve for engaging the circular extension and a mounting end for connection to a conductive wire. A contacting ring made from a braid provides a low resistance interface between the plug and receptacle minimizing the potential for heat buildup across the interface and minimizing electrical failure.

19 Claims, 16 Drawing Sheets

(56) References Cited

U.S. PATENT DOCUMENTS

| | | | | |
|---|---|---|---|---|
| 5,807,146 | A * | 9/1998 | Baker | H01R 13/17 439/827 |
| 5,893,782 | A * | 4/1999 | Harting | H01R 13/17 439/265 |
| 8,366,498 | B2 * | 2/2013 | Mittermair | B23K 9/323 439/337 |
| 2008/0132109 | A1 | 6/2008 | Landis et al. | |
| 2011/0124245 | A1 * | 5/2011 | Fujita | H01R 13/17 439/840 |
| 2012/0003882 | A1 * | 1/2012 | Stewart | H01R 13/111 439/840 |
| 2012/0135629 | A1 * | 5/2012 | Montena | H01R 12/70 439/359 |
| 2012/0270439 | A1 | 10/2012 | Tremba et al. | |
| 2014/0017928 | A1 * | 1/2014 | Shah | H01R 13/6277 439/350 |

FOREIGN PATENT DOCUMENTS

| | | | |
|---|---|---|---|
| JP | 2010-097823 | A | 4/2010 |
| JP | 2013-069550 | A | 4/2013 |
| JP | 2014-075226 | A | 4/2014 |

* cited by examiner $$R_{OVERALL} = R_{BULK\ CABLE\ 1} + R_{PERMANENT\ CONNECTION\ 1} + R_{BULK\ TERMINAL\ 1} + R_{CONTACT} + R_{BULK\ BRAID} + R_{BULK\ TERMINAL\ 2} + R_{PERMANENT\ CONNECTION\ 2} + R_{BULK\ CABLE\ 2}$$

HIGH POWER CONNECTOR

RELATED APPLICATIONS

This application claims priority to U.S. Provisional Application No. 62/037,353, filed Aug. 14, 2014 which is incorporated herein by reference in its entirety.

FIELD OF THE INVENTION

The disclosure relates to field of Power Connectors.

DESCRIPTION OF RELATED ART

The disclosure generally relates to an electrical terminal contact and, more specifically, to a high power electrical terminal. These types of terminals are used for power distribution and transmission typically found in wind turbines and other high power applications. In these applications, the connection between the conductor and the terminal is done manually on site by highly trained personnel with hydraulic specialized crimping tools. The connectors are permanently deformed onto the cables. This process is slow, requires highly trained personnel and needs certification.

Typically, these type of plug and play high power connectors rely on a terminal structure that includes multi-contact beams, (in the order of tens), in an array. Generally these terminals are cylindrical in shape and include contact beams that are formed inwardly around the interior of the terminal creating a series of single contact points along the periphery of the interface between each beam and a mating terminal pin. Such designs are known to fail due to a cumulative current loading effect. When one point of contact fails, the current load is transferred to the next contact which fails with the extra load until finally thermal runaway occurs and complete failure of the connector occurs.

BRIEF SUMMARY

A connector system is provided that includes a plug connector and a receptacle connector. The connector system is used in high power applications such as power distribution systems including windmill and other power distribution system requiring conductive power lines. The connector system includes a plug having a conductive body with a mounting end and a connecting end. The mounting end is configured for connection to a conductive wire or power transmission line, by crimping the wire to the conductive body. The connecting end is adapted to be connected to a corresponding terminal of the mating connector. The contacting portion includes a round or cylindrical extension for engaging a sleeve portion of the mating connector. The mating connector also includes a mounting end connected to a conductive wire or power transmission line.

The connector system includes a conductive layer positioned between the mating interface of the plug and receptacle connector. The conductive layer includes a contacting ring made from a braid. The braid includes a plurality of individual conductive fibers for creating multiple contact points along the interface. In high current applications, due to resistance, heat buildup can be a potential problem for conductivity. With fewer contact points, the heat buildup can be localized, causing individual contact points to fail which in turn shifts to the next point. In this situation, failure will continue from the first failure point to the second and so forth, until the entire connection fails. In such instances, one can appreciate a high power connector having a novel contacting interface that provides a low resistance contact path.

BRIEF DESCRIPTION OF THE DRAWINGS

The disclosure is illustrated by way of example, and not limited, in the accompanying figures in which like reference numerals indicate similar elements and in which.

DETAILED DESCRIPTION

As described below, detailed embodiments of the disclosure are presented herein; however, and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the disclosure. It is to be understood that the disclosed embodiments are merely exemplary of the disclosure, which may be embodied in various forms.

Figure 1:
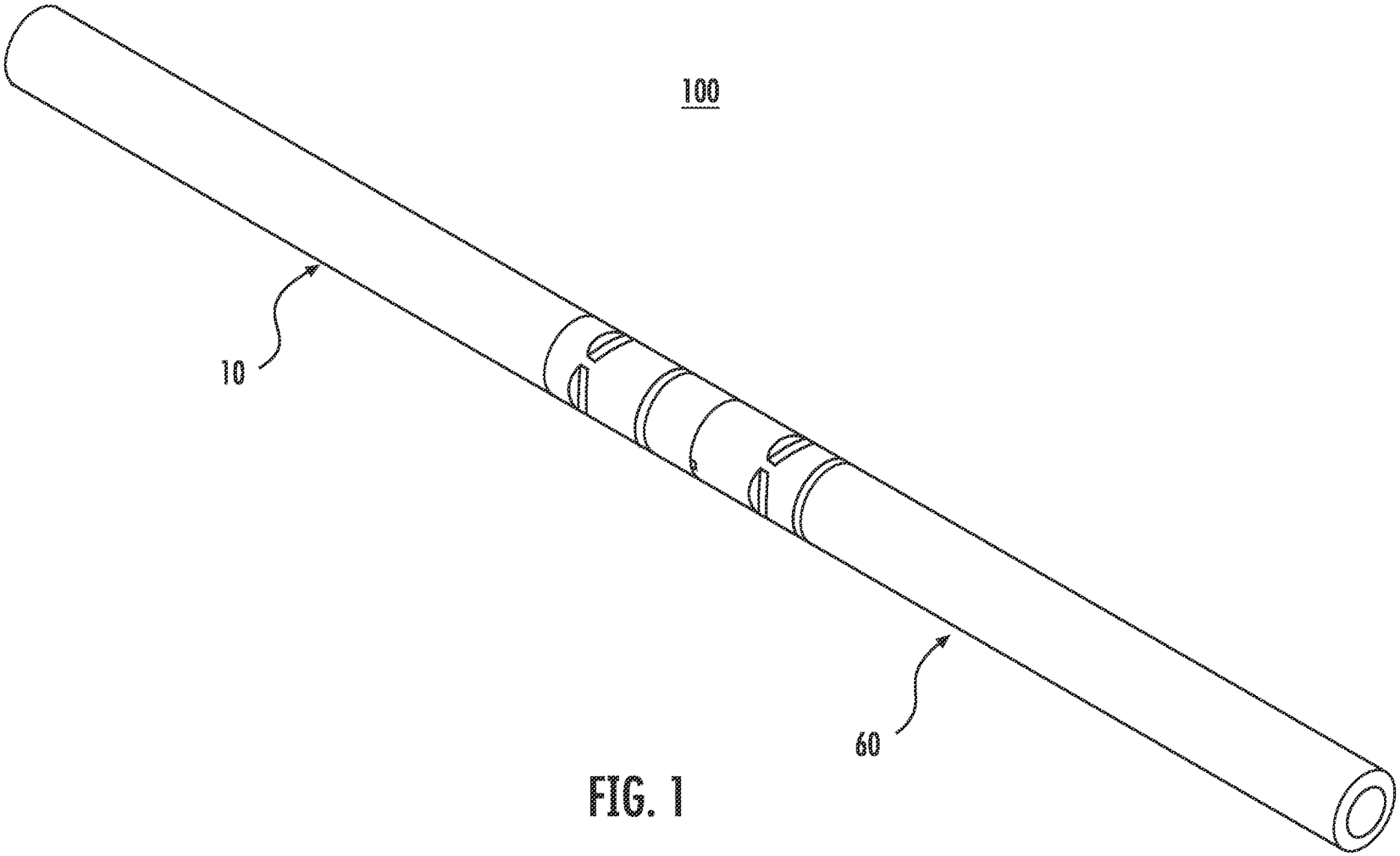
FIG. 1 is a perspective view of the connector assembly according to the disclosure.
Figure 2:
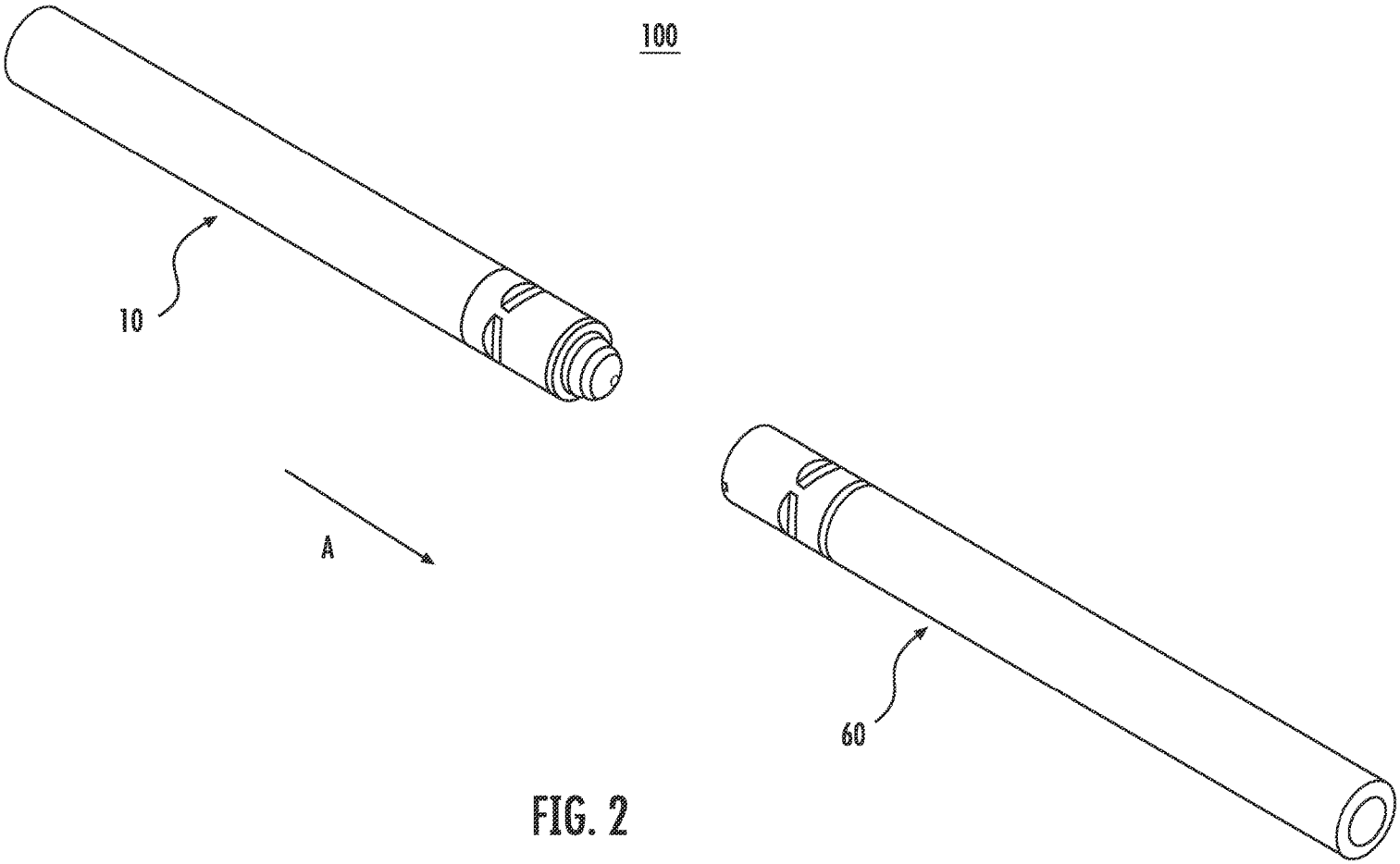
FIG. 2 is an exploded view of the connector assembly according to FIG. 1.
Figure 3:
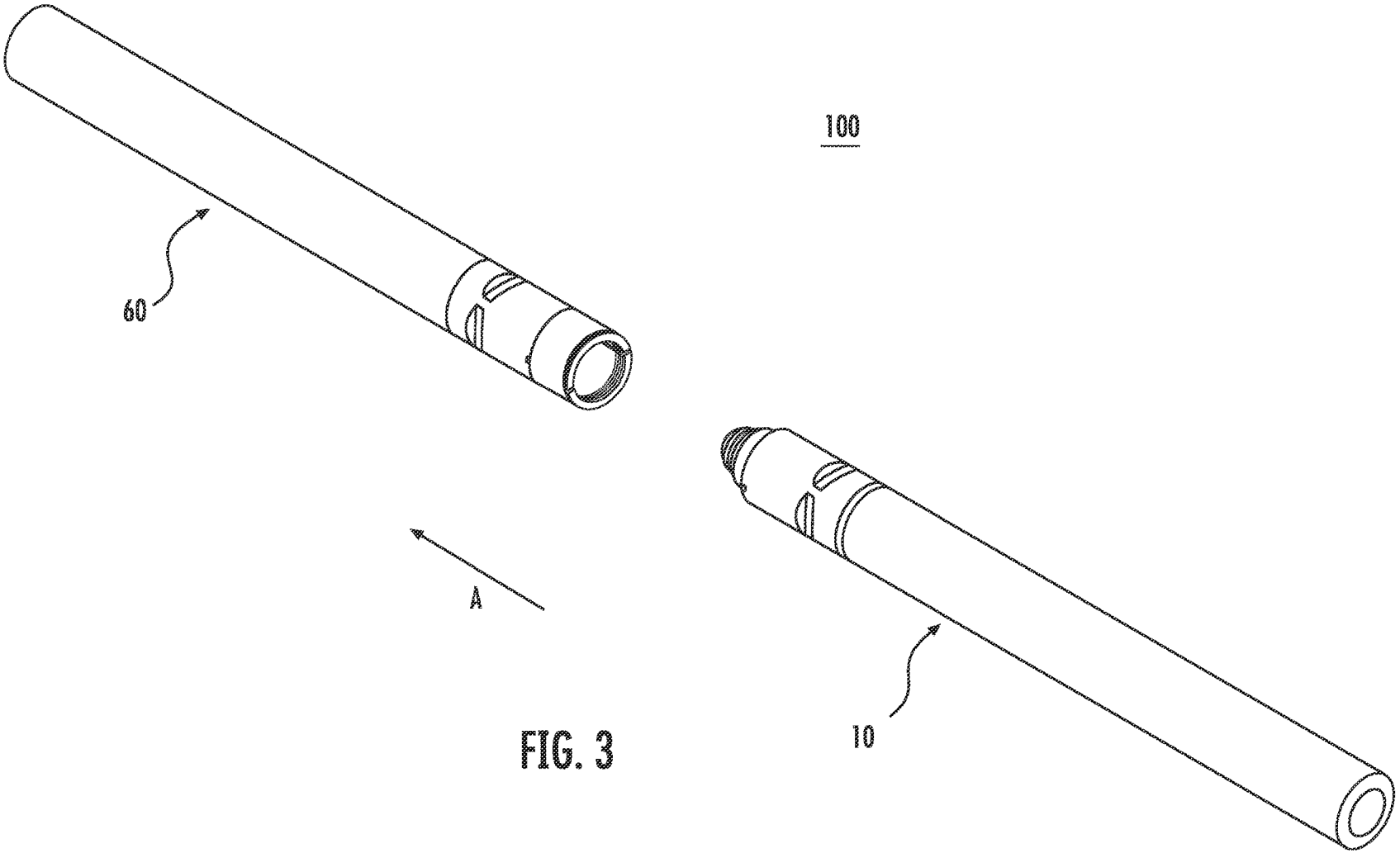
FIG. 3 is an alternative exploded view of the connector assembly according to FIG. 1.
Figure 5:
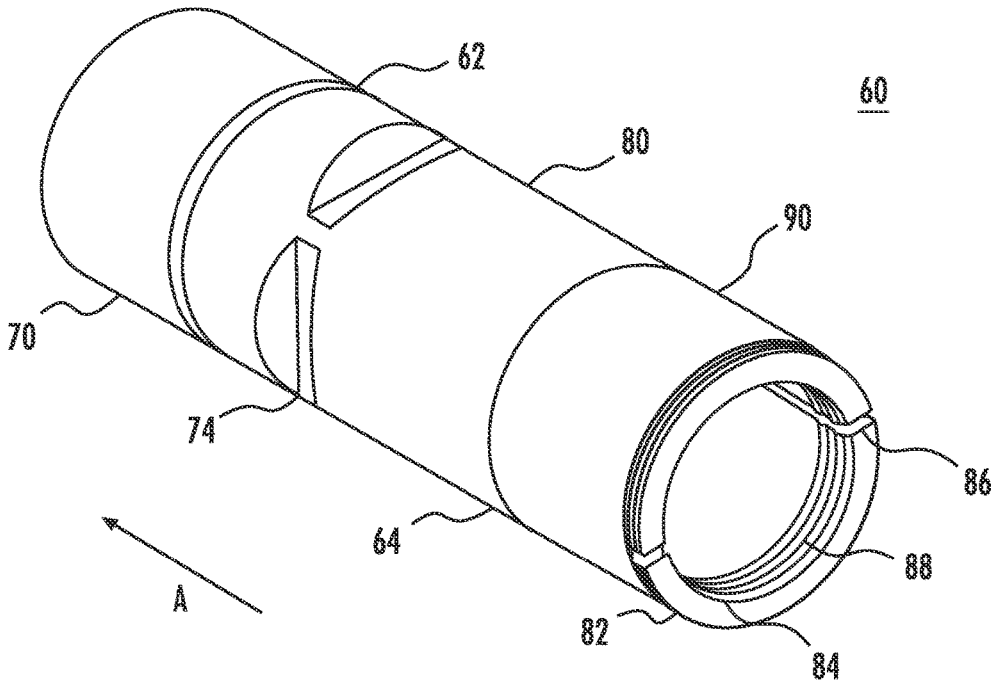
FIG. 5 is a detailed view of the mating end of the receptacle connector.
Figure 7:
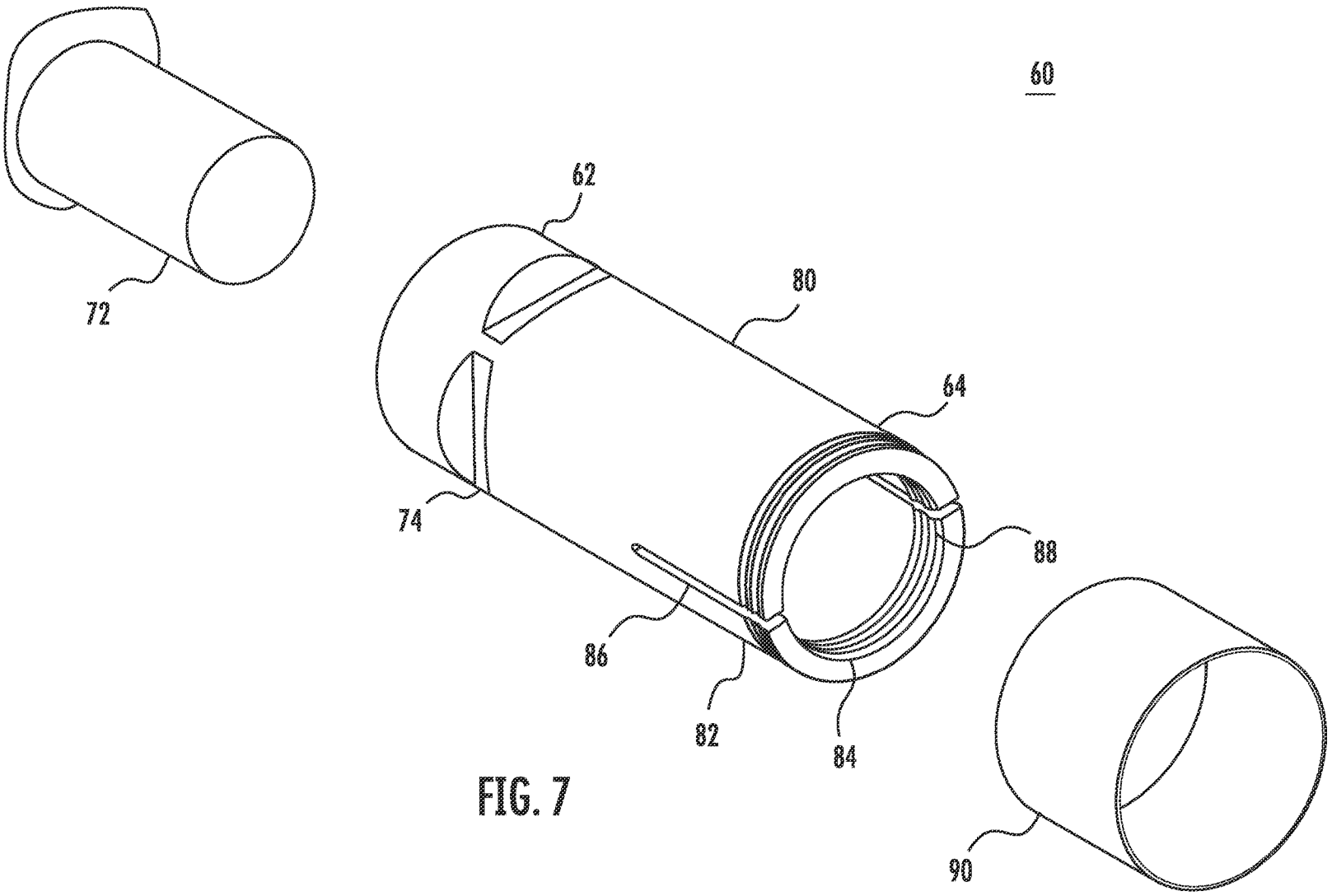
FIG. 7 is an exploded view of the mating end of the receptacle connector according to FIG. 5.
Figure 9:
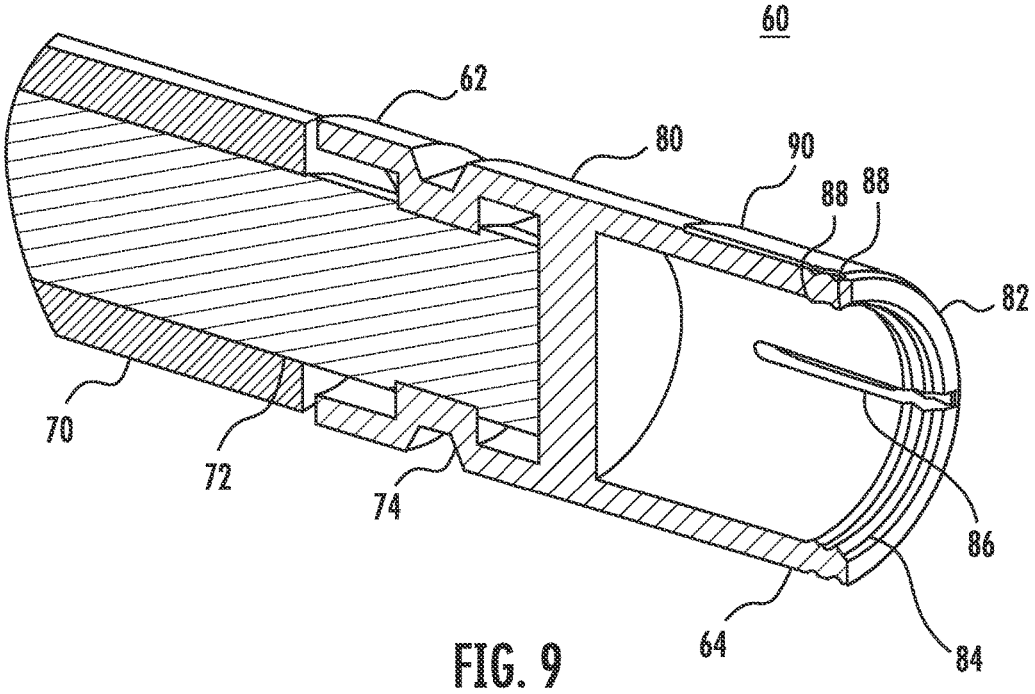
FIG. 9 is a sectional view of the mating end of the receptacle connector according to FIG. 5.

As best shown in FIGS. 1-3, the connector system 100 includes a first connector or receptacle connector 60 and a second connector or plug connector 10 adapted to be mated together in electrical engagement along a direction A. As shown in FIGS. 5, 7 and 9 the receptacle connector 60 includes a conductive body 80 made from an electrically conductive material usually copper or a copper based alloy. In certain power line transmission applications aluminum may also be used as the conductive element. A mounting end 62 is disposed at one end of the body 80 and a connection end 64 is disposed at the other end of the body 80. A conductive wire 70 having an insulative jacket and an exposed conductive portion 72 is secured to the mounting end 62 of the body 80 of the receptacle connector 60. In the embodiment shown, the conductive portion 72 is inserted into the mounting portion 62 and the mounting portion 62 is crimped 74 to secure the conductive portion 72 to the body 80. Other embodiments include attachment methods such as welding or soldering.

The connection end 64 of the body 80 is constructed in the form of a sleeve 82 having an opening 84 and a pair of slots 86 formed therein. The interior of the sleeve includes a pair of projections 88 formed on the interior surface of the opening 84 of the sleeve 82 and extends around the circular periphery of the opening 84. In the embodiment shown, the projections 88 are shown as circular, but other shapes are contemplated. The slots 86 formed in the side of the sleeve 82 create flexibility in the sleeve 82 allowing for deflection and expansion of the sleeve 82 upon insertion of the mating connector. A clamp 90 is disposed on the exterior portion of the sleeve 82 and placed over the slots 86. The clamp 90 limits the deflection and expansion of the sleeve 82 proving overstress protection and increasing normal force when the connectors are mated together. In the present embodiment, the clamp is made from a higher tensile strength material such as stainless steel, but alternative materials can be appreciated that constrain the sleeve 82 from expanding.

Figure 4:
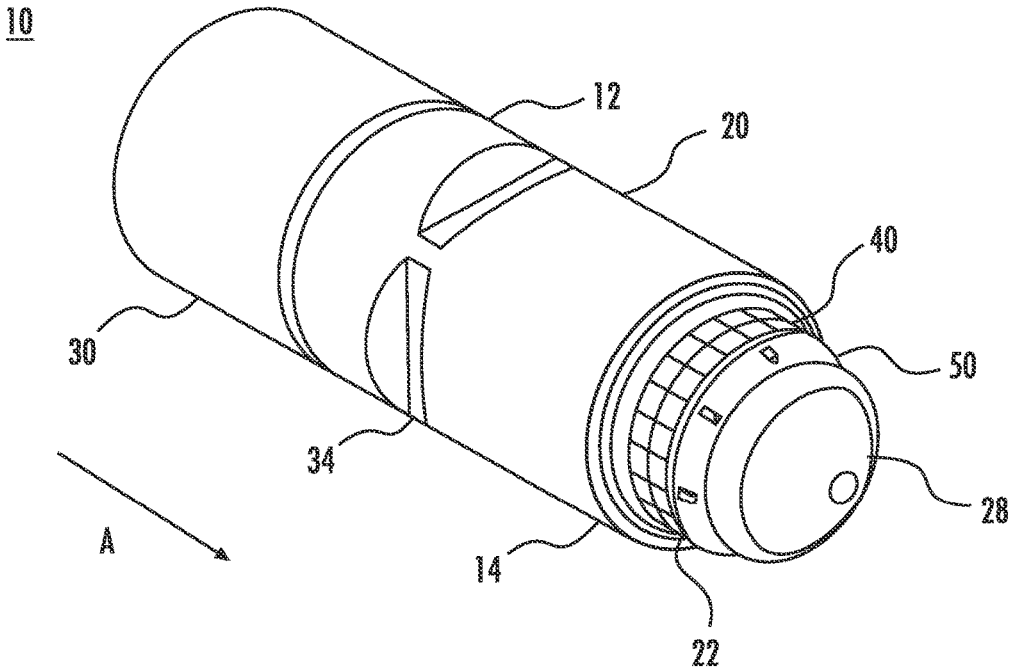
FIG. 4 is a detailed view of the mating end of the plug connector.
Figure 6:
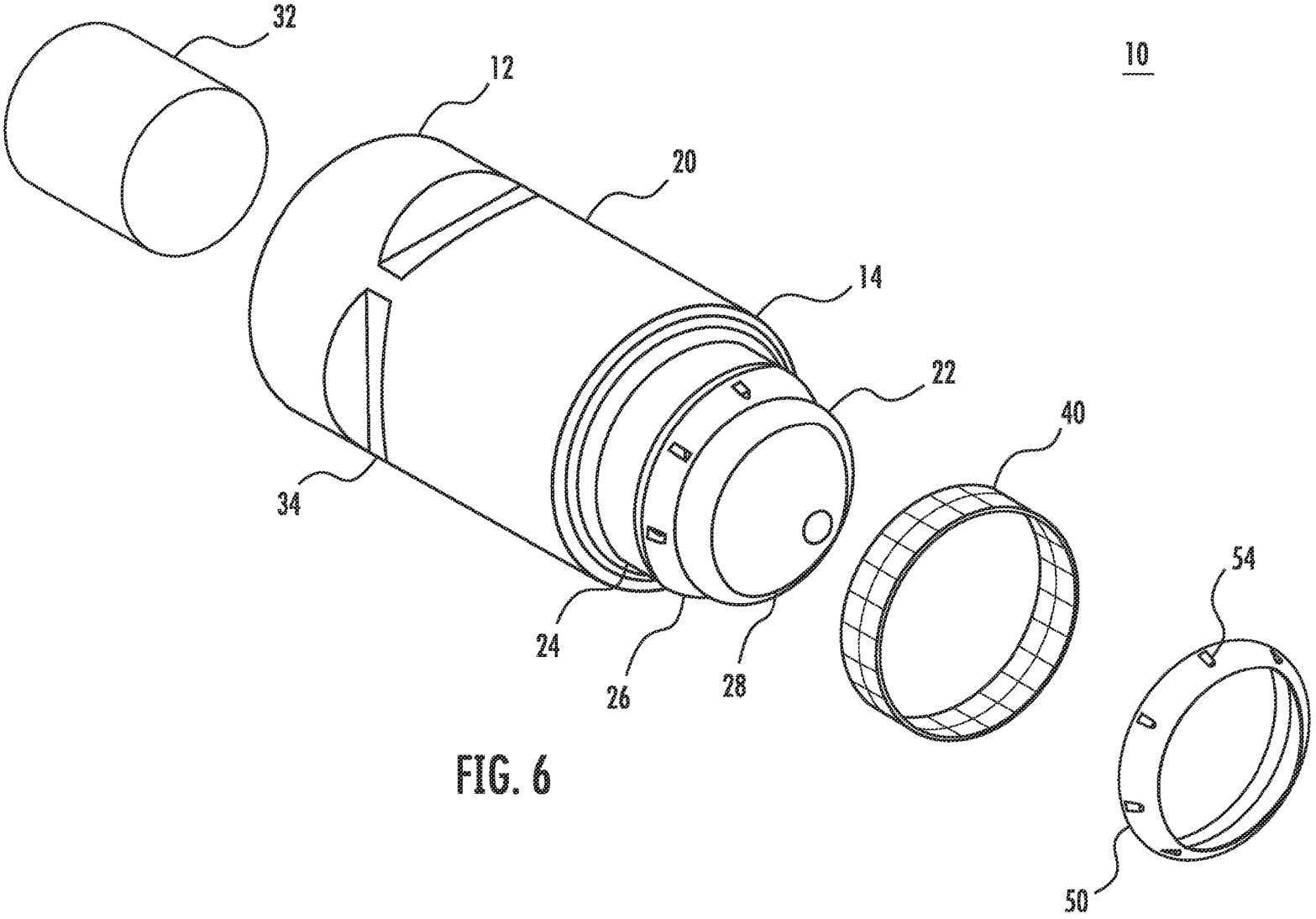
FIG. 6 is an exploded view of the mating end of the plug connector according to FIG. 4.
Figure 8:
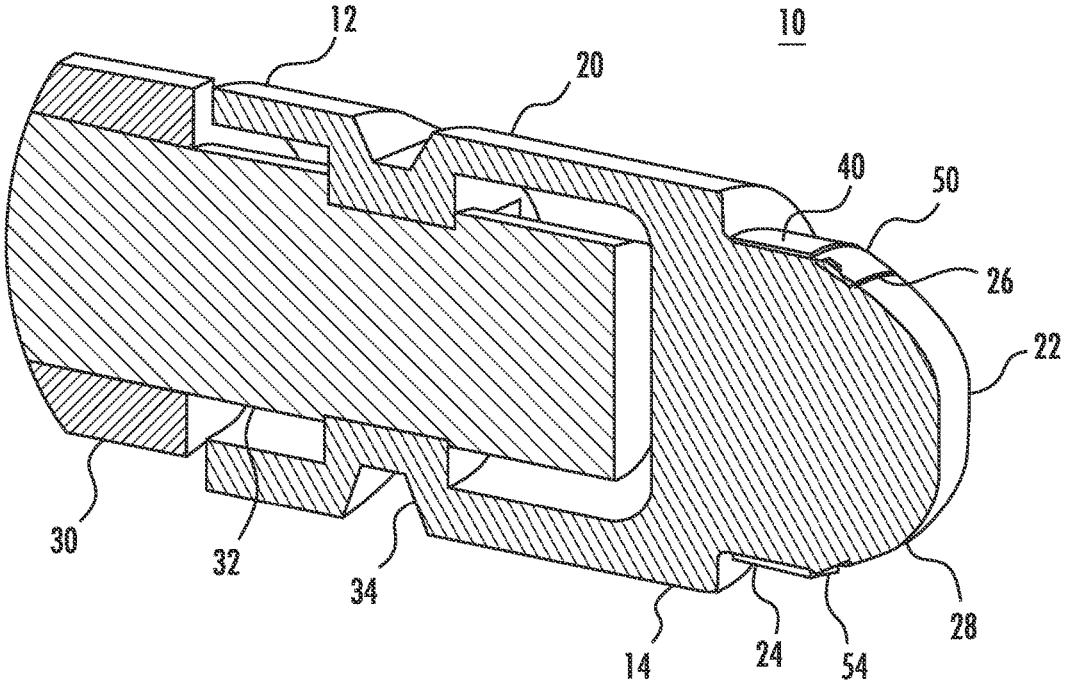
FIG. 8 is a sectional view of the mating end of the plug connector according to FIG. 4.

As illustrated in FIGS. 4, 6 and 8, the second connector or plug connector is shown having a body 20 including a mounting end 12 extending from one end of the body 20 and a connection end 14 extending from the other end of the body 20. A conductive wire 30 having an insulative jacket and an exposed conductive portion 32 is secured to the mounting end 12 of the body 20 of the plug connector 10. In the embodiment shown, the conductive portion 32 is inserted into the mounting portion 12 and the mounting portion 12 is crimped 34 to secure the conductive portion 32 to the body 20. Other embodiments include attachment methods such as welding or soldering.

The plug connector 10 includes a body 20 with a connection end 14 having a circular portion 24 extending from the body 20 along direction A. Although the extension 24 in the embodiment is shown as being circular, other cross-sections are contemplated, such as square, hexagonal and so forth. The extension 24 includes a rounded tip 28 for providing a lead-in when the plug connector 10 is mated with the receptacle connector 60. A contacting ring 40 conforming to the shape of the extension 24, in this embodiment, which is circular, is disposed on the extension 24 and a collar 50 is placed over the extension 24 and retains the contacting ring 40 on the extension 24.

Figure 10:
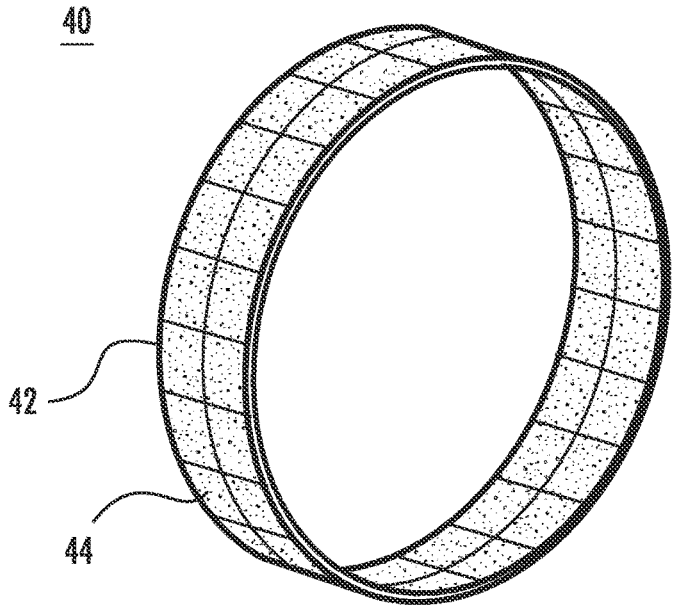
FIG. 10 is a perspective view of the contacting ring.
Figure 11:
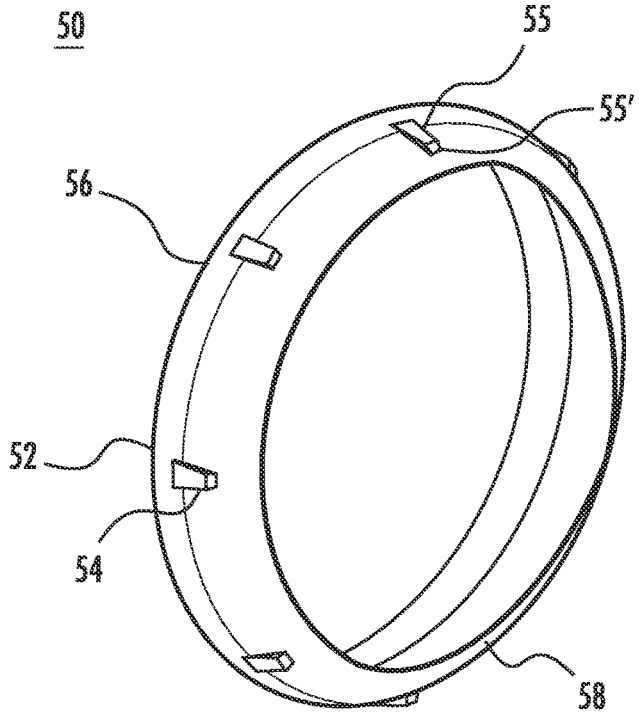
FIG. 11 is a perspective view of the collar.

The contacting ring 40, as best depicted in FIG. 10 is made from individual conductive fibers 42 woven into a braid 44, in this embodiment the braid would be a silver plated copper braid and is produced by weaving multiple single strands together into a meshed pattern. In the embodiment shown, the individual conductive fibers are shown to be copper with silver plating, alternative embodiments can include other copper based alloys or conductive materials with other highly conductive plating such as tin or gold. The braids conform to Mil Spec QQB575 or A-A-59569 and are supplied in tubular form. As best shown in FIG. 11 the collar 50 is formed into the same shape as the extension and is disposed on the extension 24. The collar 50 is formed from a metallic material but can also be formed from an insulative material. The collar includes a mounting end 56 and a nose end 58.

Once the contacting ring 40 has been positioned on the extension 24 the collar 50 is placed over the extension 24 and translated toward the contacting ring 40. The mounting end 56 of the collar 50 engages the leading edge of the braid 44 of the contacting ring 40 and is crimped or compressed inward, clamping the contacting ring 40 in place. To aid in the assembly, a recess 26 is formed in the extension 24 creating a pocket 26 for the collar 50 to reside. The pocket 26 further locates the collar 50 and the contacting ring 40 in place on the extension 24. This is established during the assembly of the contacting ring 40 and the collar 50 by creating tactile feedback, that is, as the collar 50 is advanced toward the contacting ring 40, the collar 50 is essentially pushed on to the extension 24 and snaps into the pocket 26 as the mounting end 56 of the collar 50 clamps down on the confronting edge of the contacting ring 40. The collar 50 can be further compressed to finally lock down the collar 50 on the extension 24. Additionally, the collar 50 includes a plurality of spaced apart ramps 54 formed on the exterior surface of the collar 50 and these ramps 54 include tapered edges 55, 55' to further guide the extension 24 of the plug 10 into the sleeve 82 of the receptacle 60 during mating.

Figure 12:
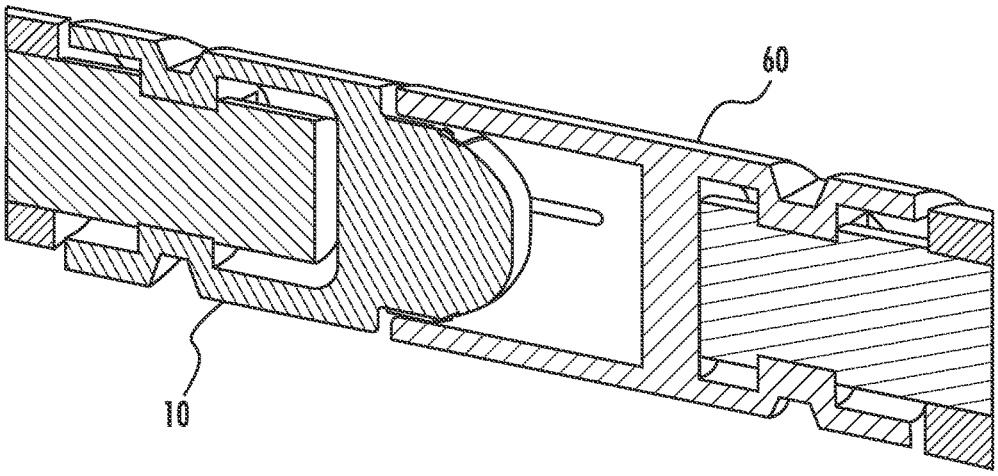
FIG. 12 is a sectional view of the connector assembly according to FIG. 1.
Figure 13:
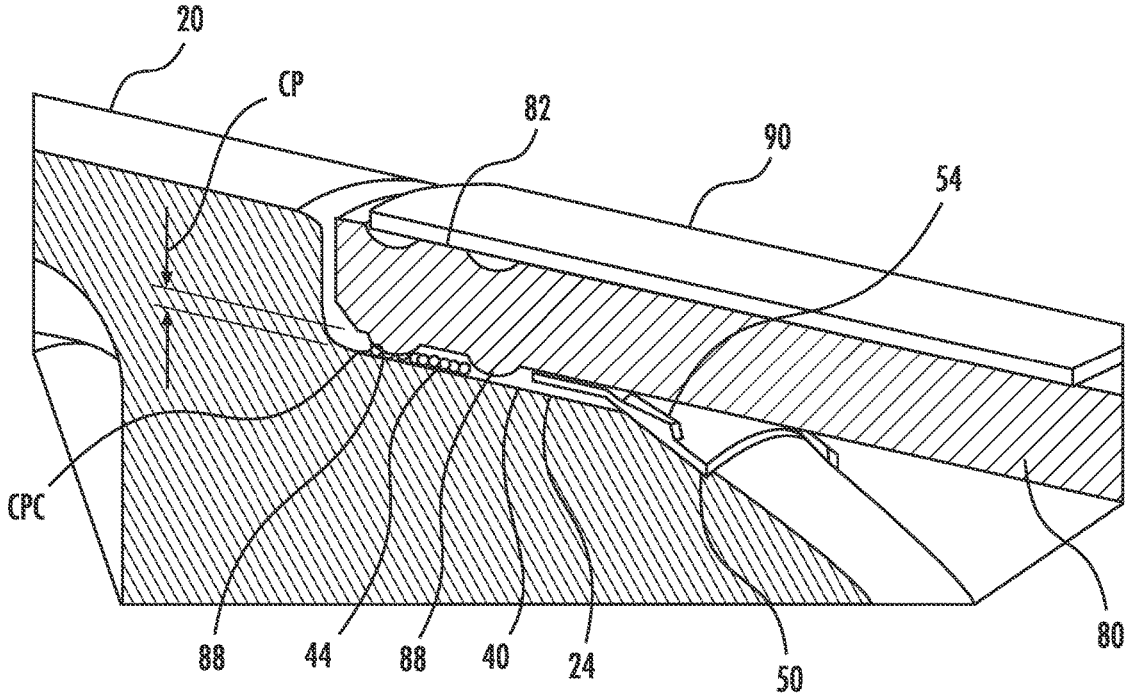
FIG. 13 is a detail view of the connector assembly according to FIG. 12.

The mated assembly is illustrated in FIGS. 12 and 13. The plug connector 10 is inserted into the sleeve 82 of the receptacle 90 with the tip 28 aligned with the opening 84. As the plug 60 is further inserted, the tip 28 guides the plug 10 and pre-aligns the plug 60 in the axial direction A. Upon further insertion, the ramps 54 provide a finer degree of alignment by the tapered edges 55, 55' contacting the internal surface of the sleeve 82 and further aligning the extension 24 of the plug 10 with the opening 84 of the sleeve 82. Once aligned, further insertion of the extension 24 initiates electrical contact between the contacting ring 40 positioned on the extension 24 with the connection end 64 of the sleeve 82.

As best illustrated in FIG. 13, upon complete mating of the plug 10 to the receptacle 60, electrical contact between the connectors is made through the contacting ring 40. As shown, the projections 88 formed on the sleeve 82 are disposed directly on the braid 44 of the contacting ring 40. Due to the biasing effects and the resiliency of the sleeve 82 combined with the added stiffening of the clamp 90, the projections 88 protrude into the braid 42. The construction of the braid 44 permits the individual conductive fibers 42 to shift and allows the fibers 42 to conform to the shape of the projections 88 that are in engagement with the braid 44. In this instance, the braid essentially surrounds the projections 88. Once mated, the current passes from the cable 70 through the female socket 80 and sleeve 82 and is evenly distributed across the many points of contact created by the braid 44 and contact between receptacle connector 60 and the extension 24 of the plug connector 10.

Figure 15:
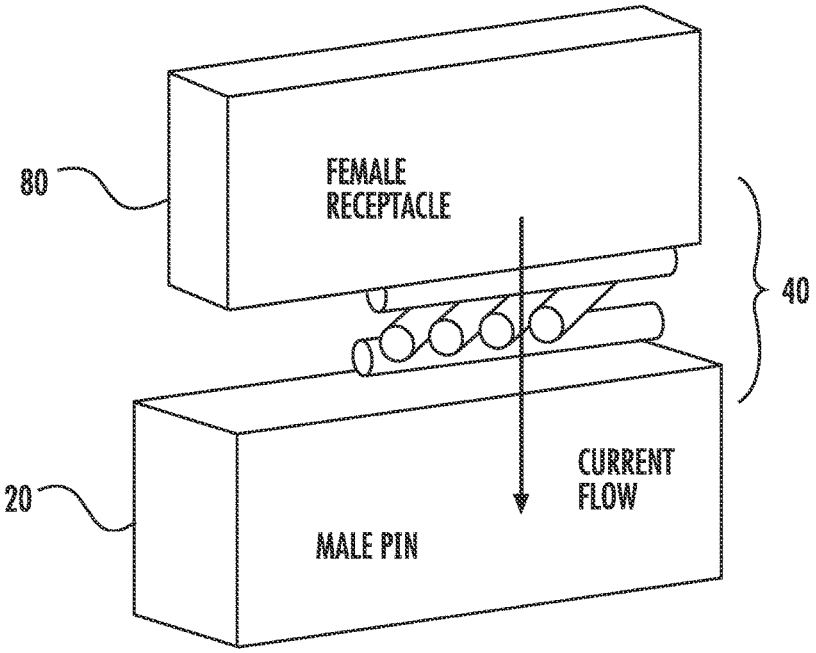
FIG. 15 is a schematic of the current flow through the contacting ring.
Figure 16:
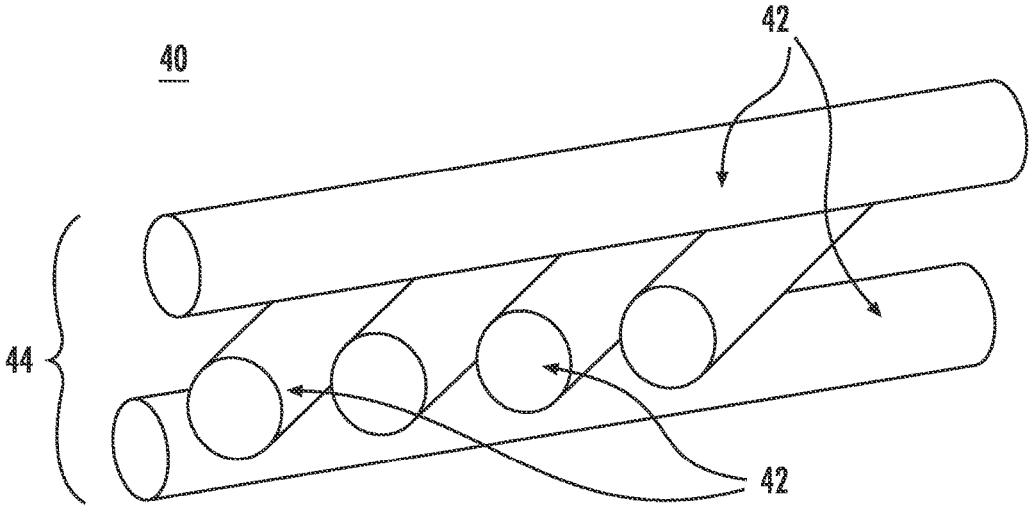
FIG. 16 is an electrical model of the contacting ring.
Figure 17:
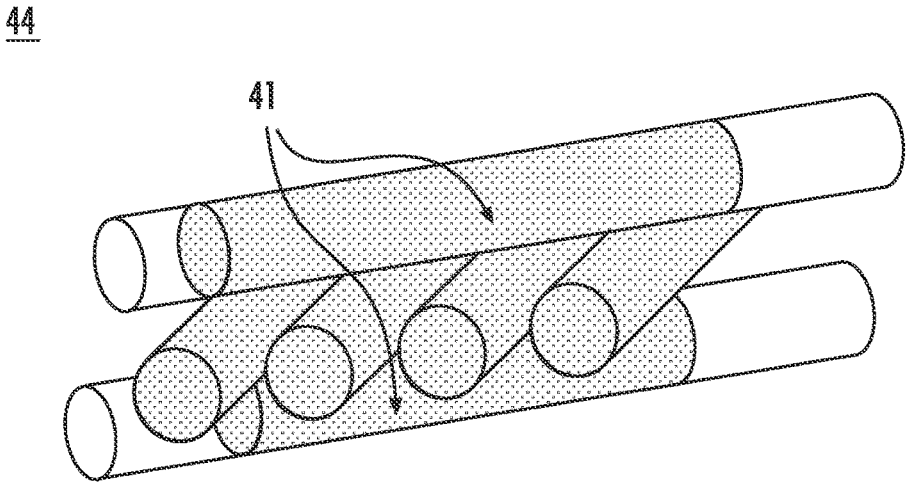
FIG. 17 is another schematic model of the contacting ring.
Figure 18:
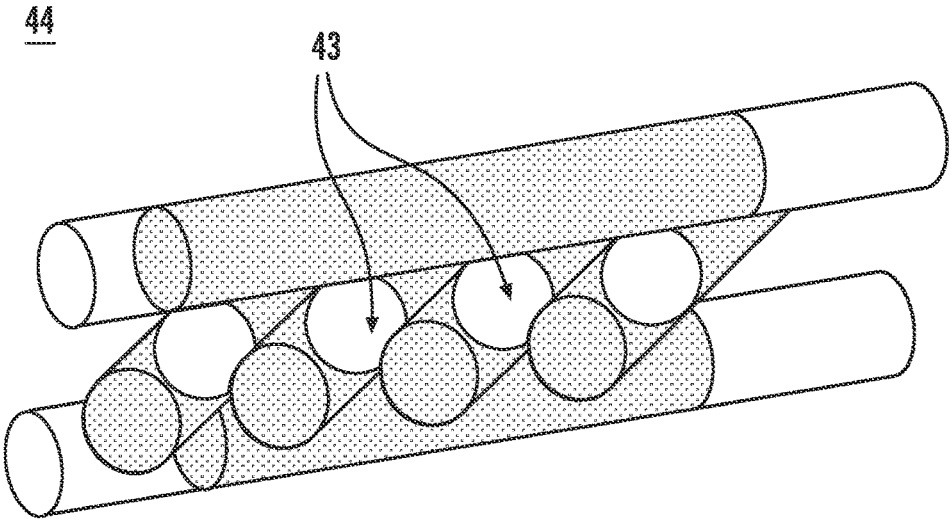
FIG. 18 is a further schematic model of the contacting ring.

In an alternative embodiment (not shown), the extension of the plug connector may include a step portion, that is, the extension will have an additional portion that has a smaller diameter. In this embodiment, the connector assembly will include two electrical interfaces that utilize a contacting ring. Each contacting ring will be size appropriately for each stepped portion of the extension. The receptacle connector includes a stepped sleeve that is matched with the corresponding stepped portion of the extension. In this embodiment, there is a second electrical interface that can divide the current passing through the connector system even further. The process of splitting the current over hundreds of points of contact reduces Joule heating of the connector. The braid interface length also minimizes the Joule heating process. The braid length is less than 1 mm. For example a 1000 Amp load can be split into more manageable loads of 5A across the braid interface. A section through the braid interface is depicted in FIGS. 13 and 15.

Figure 24:
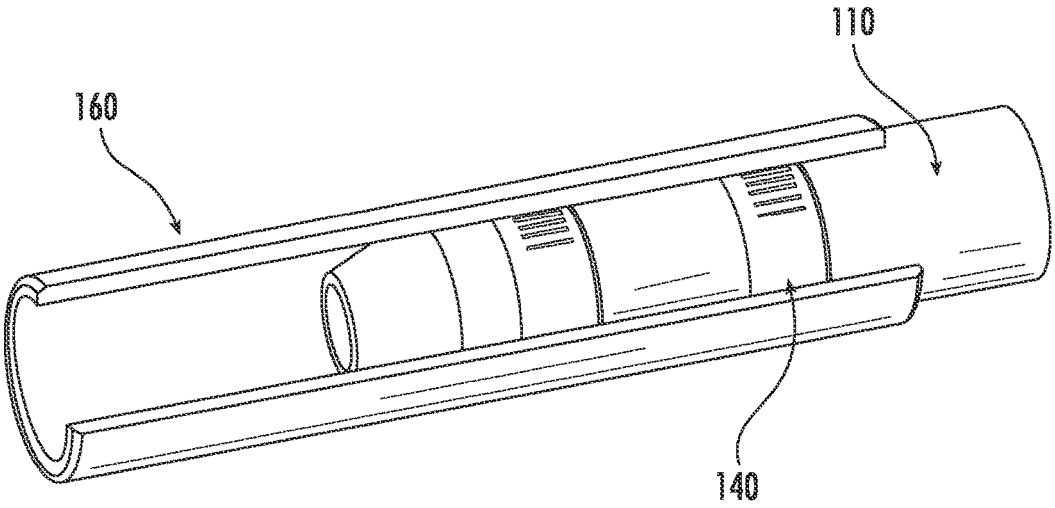
FIG. 24 (PRIOR ART)
FIG. 24 is a perspective view of the prior art.

As shown in FIG. 24 Louvertac bands 140 are commonly used in current designs to split the current across high power interfaces. The male crimp pin 110 includes one or more recesses to accept the Lourvertac bands 140 which can be Cu Zn Ni Ag & Sn plated. For example, a Louvertac male terminal (LAIBS Type) 0.15 mm BeCu can be bought in 3 feet lengths minimum Ag over Ni plated; rated 1100 A/band for ID 36.8 mm female terminal 160 and rated 900 A/band for ID 30 mm female terminal with an option to reduce the diameter by adding extra bands. The female crimp terminal 160 can be Cu Zn Ni Ag & Sn plated.

Figure 14:
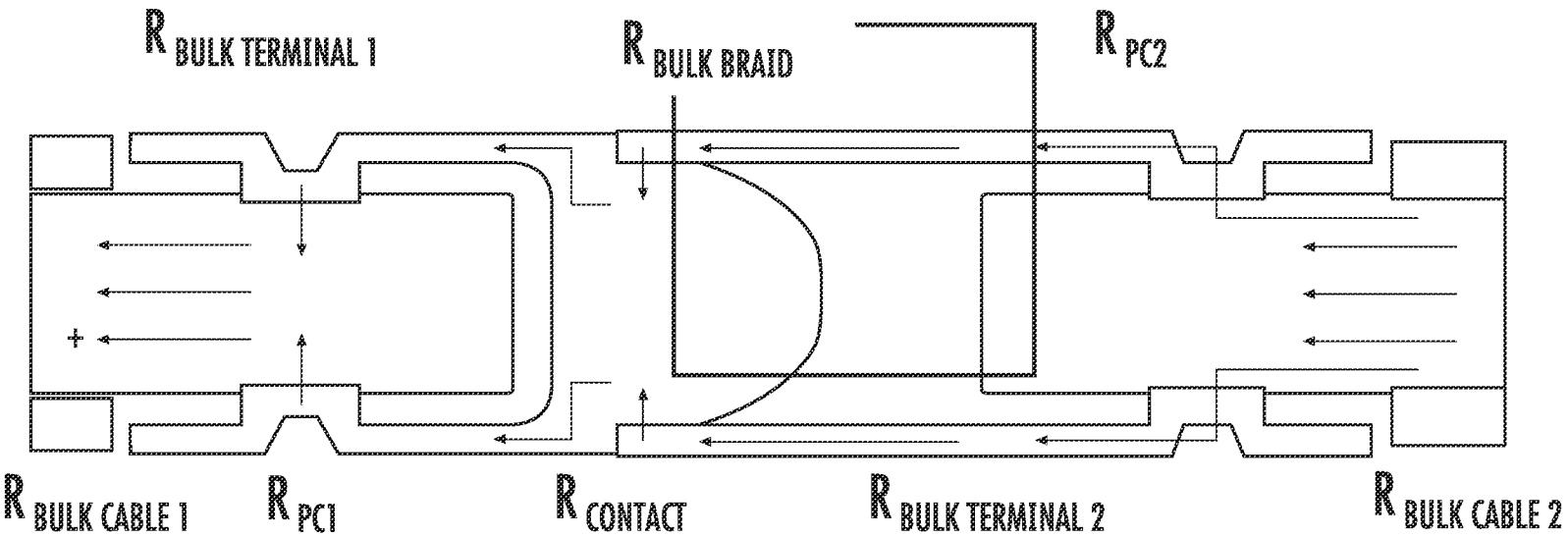
FIG. 14 is a schematic representing current flow and resistance of the connector assembly according to FIG. 1.

The design of the embodiment shown improves upon Louvertac bands 140 by providing a lower Resistance (bulk braid) which reduces the overall resistance. FIGS. 12 and 13 show circumferential points of contact CPC and also the minimum length for current path CP. As shown in FIG. 14, an electrical resistance model is represented by Resistance (overall)=Resistance (bulk cable 1)+Resistance (permanent connection 1)+Resistance (bulk terminal 1)+Resistance (contact)+Resistance (bulk braid)+Resistance (bulk terminal 2)+Resistance (permanent connection 2)+Resistance (bulk cable 2).

Figure 19:
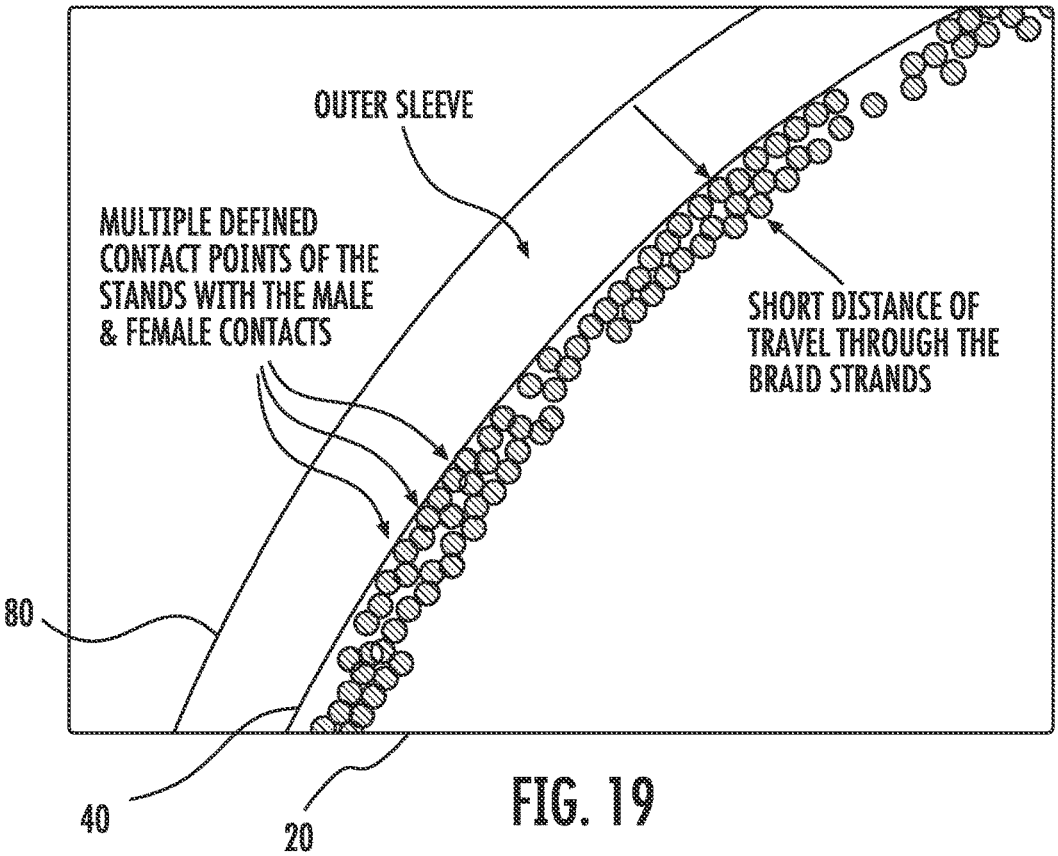
FIG. 19 is a detailed view of the braid of the contacting ring of the connector assembly according to FIG. 1.
Figure 20:
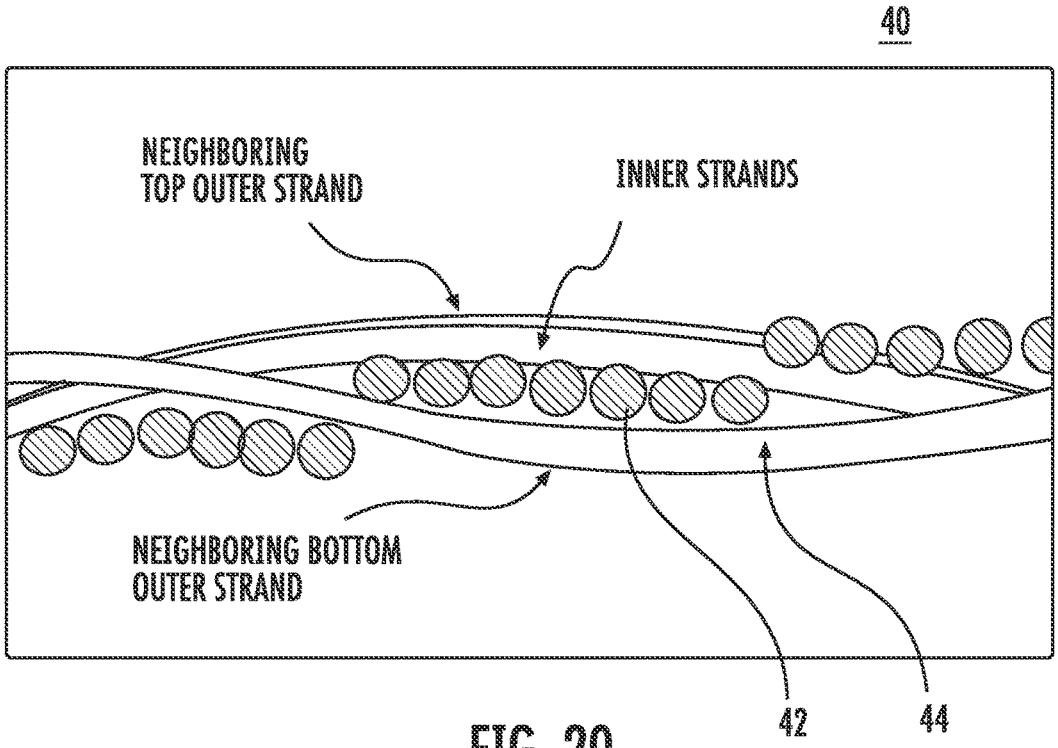
FIG. 20 is a detailed view of the braid of the contacting ring.
Figure 21:
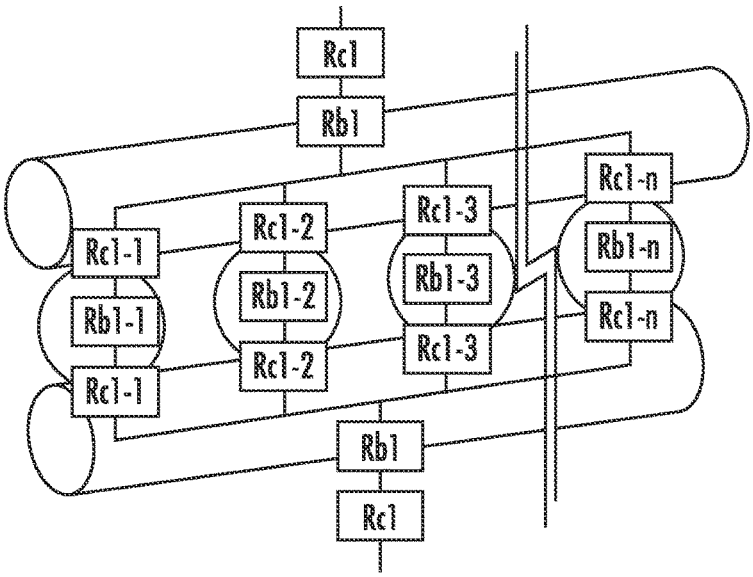
FIG. 21 is a resistance model of the braid of the contacting ring.
Figure 22:
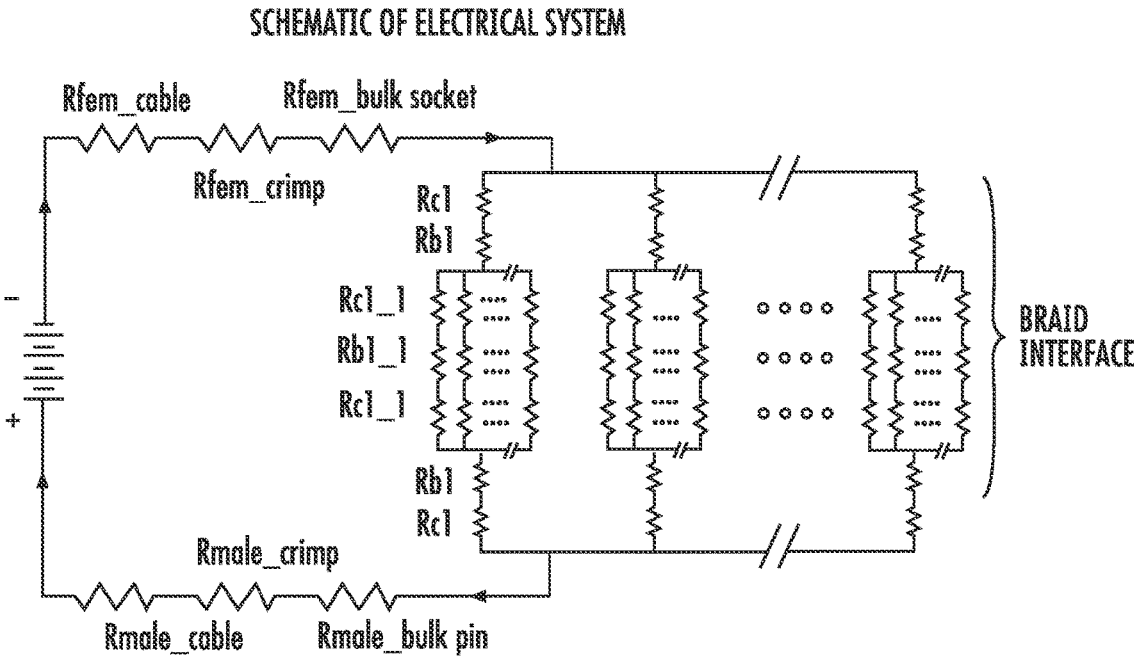
FIG. 22 is an overall electrical resistance schematic of the connector and the contacting ring interface.
Figure 23:
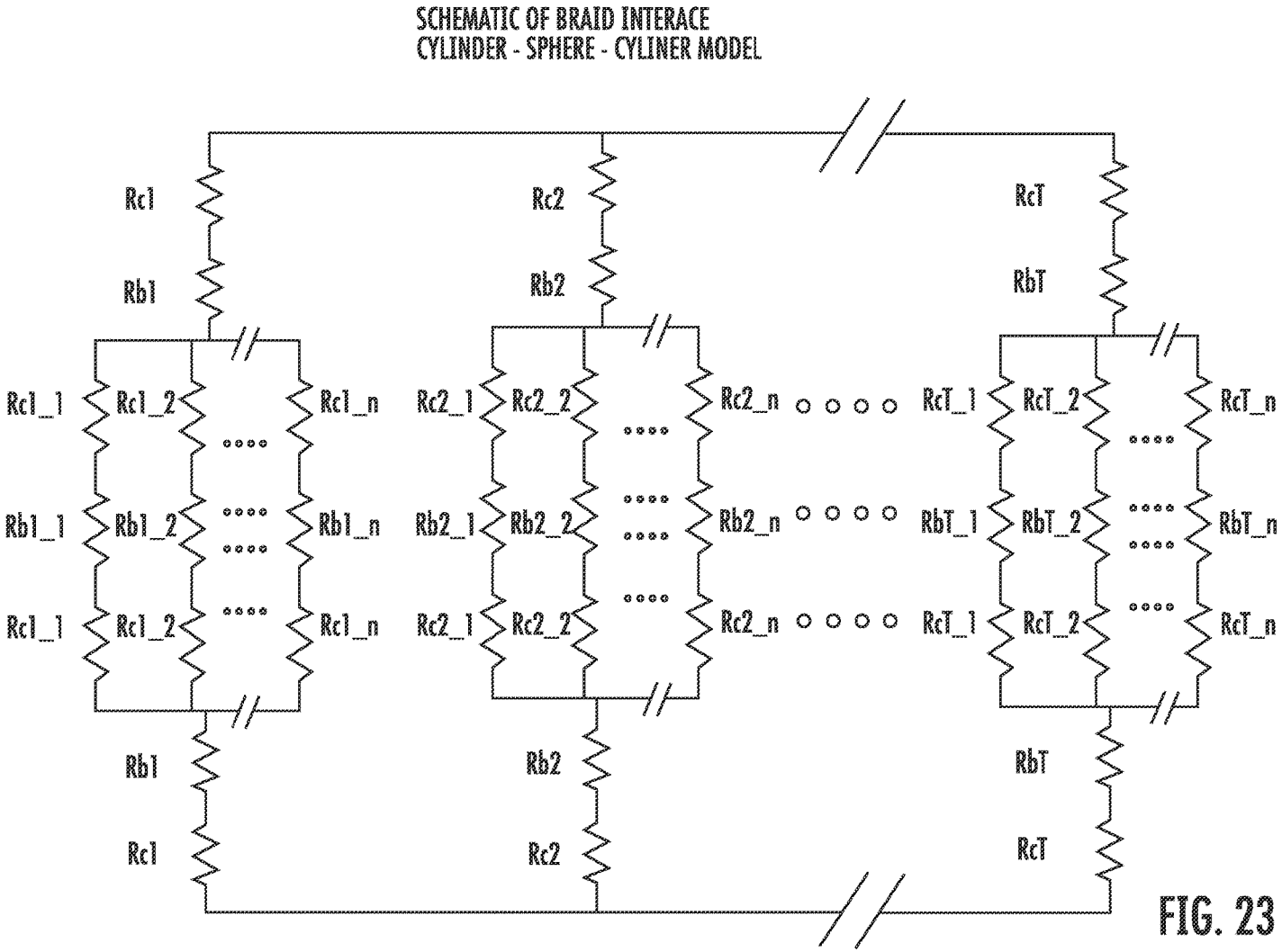
FIG. 23 is an electrical resistance schematic of the braid portion of the overall connector interface according to FIG. 22.

If it is assumed that current travels from the center of the circular cross section through the strands and into the outer sleeve, then the distance it must travel through the braid strands is very small as shown in FIG. 19. Pouillets Law defines the Resistance, R, as the material resistivity, p, multiplied by the distance of current travel, L, divided by the Cross sectional area, A, normal to the direction of current travel, R=pL/A. So, if L is small, then the Resistance will also be small and this is one of the reasons the braid works so well. FIGS. 15-18 show current path through the system, while FIG. 21 shows current path resistance. The schematic shown in FIGS. 22 and 23 provides a general description of the typical resistance arrangement that can be expected using the braid interface. Another advantage of the system is that it creates multiple contact high points in an arrayed pattern that is definable and predictable which is an advantage to the designer.

Other factors with this electrical interface that must be considered are increasing the braid pitch reduces the quantity of parallel paths for current flow which increases the electrical resistance and resultant Joule heating. The reduction in strand quantity increases the thermal resistance of the connector. The combined thereto-electric effect increases the temperature of the braid interface. Increasing the contact force reduces the interface electrical resistance by increasing the contact area available to the braid and terminals. This reduction in resistance reduces the Joule heating of the device and overall temperature rise of the interface. The connector design should minimize Joule heating by having a copper braid material of maximum strand diameter, tightly packed strand-to-strand pitch, have a plating surface coating with high thermal and electrical conductivity-to-hardness ratio, (silver is optimum for this situation), and as high a contact force as possible, taking account of braid damage, applied to each strand.

The above description illustrates a connector assembly system for a wire to wire connection system. The system is shown as a single wire conductor to a single wire conductor with a connection element in the form of a pin and socket. The pin and socket are exposed and the conductive body portions of the plug and socket can be accessed without any insulative barrier. In other embodiments utilizing the above described high power connection system, insulative housing are incorporated.

In general, the connector system includes a pair of cooperating housings molded from an insulative material. The housings include a cavity formed through the housing that retains respective ones of the plug connector or the receptacle connector and include an interface for joining the housings together and providing a pass through opening so the plug and receptacle can be mated providing the electrical connection. The housings may also include a locking feature disposed across the interface providing a positive connection between the housing that prevents separation of the connectors in normal operation. The housings are generally molded from plastic and are rigid by nature; other housings made from elastomeric materials such as rubber can also be appreciated. These materials provide the necessary insulative barrier but also allow for a certain degree of flexible. In large scale connector systems this can provide additional strain relief and ease in handling.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

We claim:

1. A connector assembly comprising:

a first connector having a first end connected to a conductor and a second end having a sleeve, the second end including a slot formed therein and defining an opening, and a second connector having a mounting end connected to a conductor and a mating end, the mating end having a contact portion configured to fit into the opening, a contacting ring disposed on the contact portion, a collar is attached to the contact portion and retains the contacting ring on the contact portion wherein the contacting ring provides the electrical connection between the sleeve and the contact portion upon mating of the first connector to the second connector.

2. The connector assembly according to claim 1, wherein the collar includes an alignment ramp.

3. The connector assembly according to claim 2, wherein the collar is made from a conductive material.

4. The connector assembly according to claim 1, wherein the contacting ring is a braid.

5. The connector assembly according to claim 4, wherein the braid is constructed of individual conductive fibers.

6. The connector assembly according to claim 5, wherein the braid is copper.

7. The connector assembly according to claim 1, wherein the opening includes a projection.

8. The connector assembly according to claim 7, wherein the projection is disposed annularly around the opening.

9. The connector assembly according to claim 8, wherein the opening includes a second projection.

10. The connector assembly according to claim 9, wherein the projection has a circular cross-section.

11. The connector assembly according to claim 1, wherein a clamp is disposed on the sleeve.

12. A connector comprising:

a mounting end connected to a conductor and a mating end, the mating end having a contact portion, the contact portion configured to engage a sleeve formed on a second connector, the contact portion includes a contacting ring disposed on the contact portion and a collar attached to the contact portion to retain the contacting on the contact portion wherein the contacting ring provides the electrical connection between the contact portion and the sleeve upon mating of the connector to the second connector.

13. The connector according to claim 12, wherein the collar includes an alignment ramp.

14. The connector according to claim 12, wherein the contact portion is circular.

15. The connector according to claim 14, wherein the contact portion includes a step.

16. The connector according to claim 15 wherein a second contacting ring is disposed on the step.

17. The connector according to claim 12, wherein the contacting ring is a braid.

18. The connector according to claim 17, wherein the braid is constructed of individual conductive fibers.

19. The connector according to claim 18, wherein the braid is copper.

* * * * *